US006759092B2

(12) United States Patent
Buecher

(10) Patent No.: US 6,759,092 B2
(45) Date of Patent: Jul. 6, 2004

(54) METHOD AND APPARATUS OF COATING A MOVING SUBSTRATE SURFACE EMPLOYING SMOOTHING ROLL OF PARTICULAR SURFACE ROUGHNESS AND CONTROLLED TO OPERATE AT PARTICULAR SURFACE SPEED

(75) Inventor: Udo Wolfgang Buecher, Farmborough Heights (AU)

(73) Assignees: BHP Steel (JLA) Pty Ltd., Sydney (AU); Akzo Nobel PTY LTD, Camellia (AU)

( * ) Notice: Subject to any disclaimer, the term of this patent is extended or adjusted under 35 U.S.C. 154(b) by 0 days.

(21) Appl. No.: 10/130,747

(22) PCT Filed: Dec. 1, 2000

(86) PCT No.: PCT/AU00/01490

§ 371 (c)(1),
(2), (4) Date: May 23, 2002

(87) PCT Pub. No.: WO01/39895

PCT Pub. Date: Jun. 7, 2001

(65) Prior Publication Data

US 2003/0021899 A1 Jan. 30, 2003

(30) Foreign Application Priority Data

| | | |
|---|---|---|
| Dec. 3, 1999 | (AU) | PQ 4449 |
| Mar. 7, 2000 | (AU) | PQ 6067 |
| Apr. 20, 2000 | (AU) | PQ 7080 |

(51) Int. Cl.[7] ..... B05D 1/28; B05D 1/40

(52) U.S. Cl. ..... 427/359; 427/428

(58) Field of Search ..... 427/359, 428; 118/110, 118, 261

(56) References Cited

U.S. PATENT DOCUMENTS

| | | | | | |
|---|---|---|---|---|---|
| 5,281,435 | A | * | 1/1994 | Buecher | 427/11 |
| 5,407,697 | A | | 4/1995 | Buecher et al. | |
| 5,554,413 | A | * | 9/1996 | Nikaido et al. | 427/108 |
| 5,655,444 | A | * | 8/1997 | Kayser et al. | 100/334 |
| 5,836,860 | A | * | 11/1998 | Watanabe et al. | 492/56 |

FOREIGN PATENT DOCUMENTS

| | | | |
|---|---|---|---|
| WO | 98/13145 | * | 4/1998 |

* cited by examiner

*Primary Examiner*—Katherine A. Bareford
(74) *Attorney, Agent, or Firm*—Miles & Stockbridge P.C.; John C. Kerins

(57) ABSTRACT

A method of providing a paint coat of an organic polymeric paint composition on a surface of a moving substrate is provided, which includes establishing a quantity of the paint composition, in a high solids form at a temperature such that it is spreadable, in a hip defined by the substrate surface and a smoothing roll to enable paint from the established quantity to pass through the nip as a paint layer on the substrate surface, wherein the smoothing roll has a surface roughness coefficient (Ra) of no more than 1.5, and wherein the maximum surface speed of the smoothing roll expressed as a percentage of the substrate speed bears a linear relationship to the substrate speed such that the surface speed of the smoothing roll is no more than 1.2 percent of the substrate speed at an exemplary low substrate speed of 15 meters per minute and no more than 12 percent of the substrate speed at an exemplary substrate speed of 150 meters per minute.

12 Claims, 2 Drawing Sheets

METHOD AND APPARATUS OF COATING A MOVING SUBSTRATE SURFACE EMPLOYING SMOOTHING ROLL OF PARTICULAR SURFACE ROUGHNESS AND CONTROLLED TO OPERATE AT PARTICULAR SURFACE SPEED

This application is a national stage application of PCT/AU00/1490, filed Dec. 1, 2000.

TECHNICAL FIELD

This invention relates to the continuous application of organic polymeric compositions to moving substrate surfaces to form a thin coating of the composition on the surface. If the coating remains on the substrate surface to which it is applied and is caused or allowed to harden or set, the process may be generically referred to as painting the substrate surface.

More particularly, but not exclusively, the invention is directed towards the continuous painting of moving metal, for example steel, strip in the context of an industrial production line for producing painted stock material in large quantities.

BACKGROUND ART

Probably the most commonly adopted mass production processes for painting moving strip comprise applying a thin layer of liquid paint composition, for example pigmented organic polymeric particles and filler particles dispersed or dissolved in a liquid solvent, to the strip, and causing or allowing the solvent to evaporate to leave an adherent, solid coating on the strip. The formation of the liquid layer on the strip may be effected in various ways, for example by dipping the strip into a bath of the paint composition followed by stripping surplus composition from the strip, spraying the paint composition onto the strip or by contacting the strip with a roller laden with the paint composition.

Such processes using solvent rich, low viscosity compositions are not entirely satisfactory. In particular, the solvents are dangerous if inhaled, expensive and environmentally damaging, thus it is essential that they be drawn off and condensed for re-use. This requires expensive equipment and otherwise unnecessary precautionary procedures that complicate the painting operation itself. Such processes do have the advantage that the tendency of the low viscosity liquid layer to flow before solidifying and the effect of surface tension tend to flatten the surface of the liquid layer resulting in an attractive smooth surface on the finished painted product.

Nevertheless the disadvantages of solvent based compositions are such that processes utilising substantially solvent free paint compositions, so called high solids compositions, have been developed wherein the composition has been rendered sufficiently fluid for it to be spread upon the substrate by controlled heating of the composition immediately prior to its application to the substrate. It has been found that, in general, application of such compositions to a substrate at a temperature of less than 20° C. is inappropriate because the viscosity of the composition is too high. The extent to which the viscosity may be lowered by heating is limited because of the deleterious effect of high temperatures or prolonged heating on the characteristics of the paint composition. The upper temperature at which the compositions can be applied to the substrate is usually about 200° C., although this temperature is somewhat dependent upon the particular composition being used. At these elevated temperatures, it has been found that excessive cross-linking can occur prior to paint film formation. This means that in processes using high solids compositions one cannot rely on the self leveling effect of a low viscosity liquid layer to produce a smooth surface on the finished coating to the same extent as one can in processes using solvent rich compositions. That problem is exacerbated if one takes full advantage of the accuracy with which the thickness of a paint coat may be determined when using high solids compositions to create thin coats (of the order of from 10 to 20 micrometers in thickness) as disclosed in, for example, the complete specification of Australian Patent No. 622948 (John Lysaght (Australia) Pty. Ltd. et al). Thin coats set quicker than thick ones and this further detracts from the self-leveling slumping of peaks in the surface of the applied coat.

Hitherto that disadvantage of using high solids compositions has been addressed by contacting an initial deposit of paint composition on the moving substrate surface with a so called smoothing roll (as disclosed in the mentioned Australian patent specification), which is positioned to make a near approach to the substrate surface to form a nip therewith, through which nip the deposit moves. This has the effect of spreading and smoothing the initial deposit. It may also limit the thickness of the deposit carried away from the nip on the substrate surface. That prior art procedure is referred to as "a method of the kind described" hereinafter.

DISCLOSURE OF THE INVENTION

An object of the present invention is to provide a thin paint coat on a substrate surface, by a continuous coating procedure utilising high solids, organic polymeric paint compositions, having a smoother surface than has been attainable by such procedures hitherto. For the purposes of the invention a high solids composition may be defined as one having a so-called volume solids of at least 80 percent, preferably more than 95 percent. The term "volume solids" is a reference to the volume of the solids in the composition expressed as a percentage of the volume of the total composition.

The invention attains that object by the selection of parameters controlling the operation of methods of the kind described.

The invention consists in a method of providing a paint coat of an organic polymeric paint composition on a moving substrate surface, of the kind comprising establishing a quantity of the paint composition, in a high solids form at a temperature such that it is spreadable, in a nip defined by the substrate surface and a smoothing roll to enable paint from the established quantity to pass through the nip as a paint layer on the substrate surface, wherein the smoothing roll has a surface roughness coefficient (usually referred to by the symbol $R_a$) of no more than 1.5, and wherein the maximum surface speed of the smoothing roll expressed as a percentage of the substrate speed bears a linear relationship to the substrate speed, such that the surface speed of the smoothing roll is no more than 1.2 percent of the substrate speed at an exemplary low substrate speed of 15 meters per minute and no more than 12 percent of the substrate speed at an exemplary substrate speed of 150 meters per minute.

In preferred embodiments of the invention the $R_a$ is no more than 0.8. The term surface roughness coefficient or $R_a$ is a term of art defined, with reference to a sectional profile of a surface, as the arithmetic mean of the departure distances of the peaks and troughs of the profile from the mean line of the profile, expressed in micrometers. Thus the smaller is the value of $R_a$ then the smoother is the surface.

For preference the direction of movement of the surface of the smoothing roll at the nip is the same as that of the substrate. It will be noted that the invention includes within its ambit the instance of a stationary smoothing roll having zero surface speed and instances wherein the direction of movement of the smoothing roll surface is opposite to that of the substrate.

By way of example two embodiments of the above-described invention are described in mole detail hereinafter with reference to the accompanying drawings.

Figure 1:
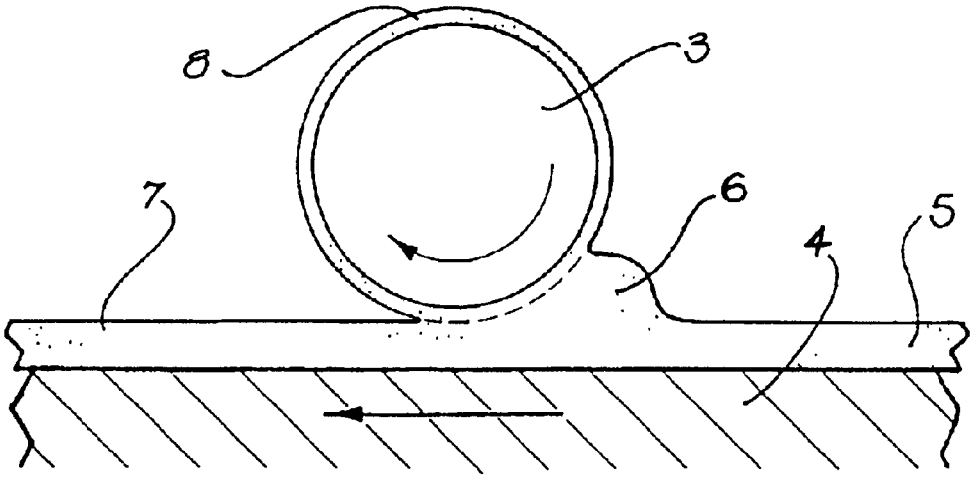
FIG. 1 is a diagrammatic longitudinal sectional elevation of an apparatus whereby the method of the invention may be performed.
Figure 2:
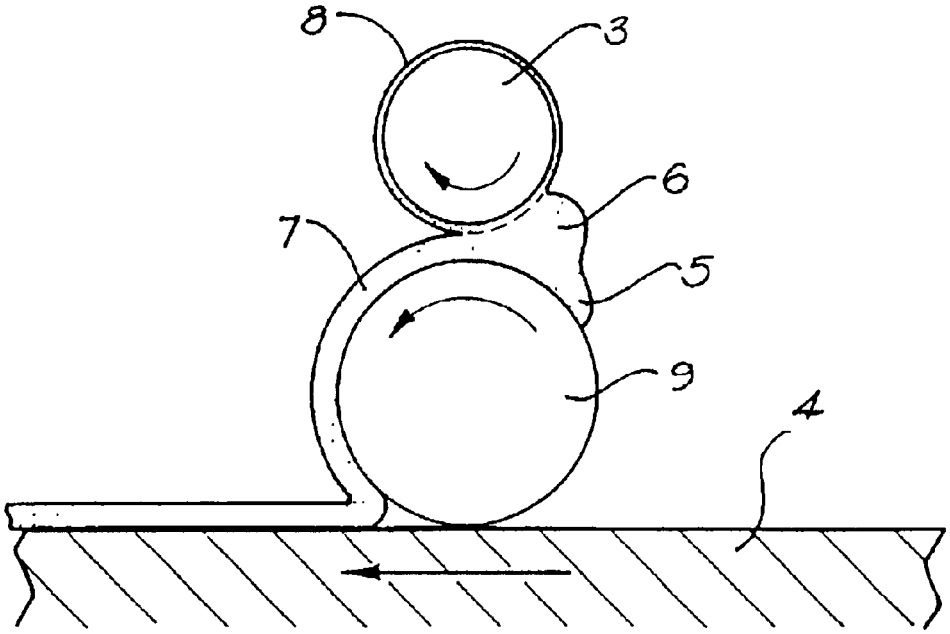
FIG. 2 is a view similar to FIG. 1 of a second apparatus whereby the method of the invention may be performed.

It should be noted that FIGS. 1 and 2 are explanatory diagrams rather than representational views of actual apparatus. They are not to scale. In particular the rolls are diminished in size and thus display much smaller radii of curvature than they would have in reality and the thicknesses of the paint layers are greatly enlarged.

MODES OF CARRYING OUT THE INVENTION

The apparatus illustrated by FIG. 1 is adapted for carrying out the method of the invention in instances where the surface to be painted is itself the substrate surface. That apparatus comprises a smoothing roll 3 forming a nip with a moving substrate metal strip 4 to be painted. The roll 3 and strip 4 are caused to move by conventional means in the directions of the arrows appearing thereon. The smoothing roll is preferably furnished with at least a surface layer of elastomeric material. For example, roll 3 may comprise a surface layer of a heat resistant silicone rubber upon a steel core. Although resilient, the elastomeric surface of the smoothing roll is relatively hard, for example it may have a Shore A hardness of from 35 to 90. In accordance with the invention the smoothing roll 3 is a very smooth roll, with an $R_a$ of no more than 1.5, with a preferred value, having regard to the difficulty and expense of obtaining very smooth surfaces, of 0.8. A back-up roll (not shown) is provided on the opposite side of the strip from the smoothing roll 3 at the nip, to support the strip against the considerable force applied to it by the smoothing roll.

A relatively rough surfaced layer 5 of a high solids organic polymeric paint composition is deposited on the strip 4 at a position upstream of the nip between it and the roll 3. The deposition of the layer 5 may be effected by any conventional means.

Preferably, the deposition rate is adjusted to suit the desired usage rate, having regard to the strip speed and the desired thickness of the finished paint coat on the strip, so as to avoid excessive spillage or overflow at the smoothing station. Nevertheless a small reserve quantity 6 of paint composition is preferably established immediately upstream of the nip.

In alternative embodiments the reserve quantity may be established by direct deposit into the nip or by deposit onto the smoothing roll for transfer thereby into the reserve quantity.

In a further alternative embodiment, the paint composition is deposited directly in the nip or is deposited directly into a pool of point composition established in the nip.

Having passed through the nip, the paint composition emerges as two streams, namely a smooth surfaced, still fluid, paint coat 7 carried away on the strip 4 and a thin film 8 carried away on the surface of the roll 3 and returned by it to the reserve quantity 6. The paint coat 7 may have a thickness of from 10 to 60 micrometers, preferably from 12 to 25 micrometers.

In commercial metal strip continuous painting lines the strip speed may typically be within the range of from 15 to 120 meters per minute. In accordance with the invention, the surface speed of the roll 3 is no more than 1.2 percent of the substrate surface speed of 15 meters per minute, rising to no more than 9.6 percent of the substrate sped at 120 meters per minute. This would place corresponding maximum roll surface speeds within the range of from 0.18 to 11.52 meters per minute. For preference however the actual surface speed of the roll in any instance would be less than those maxima and may be zero.

Figure 3:
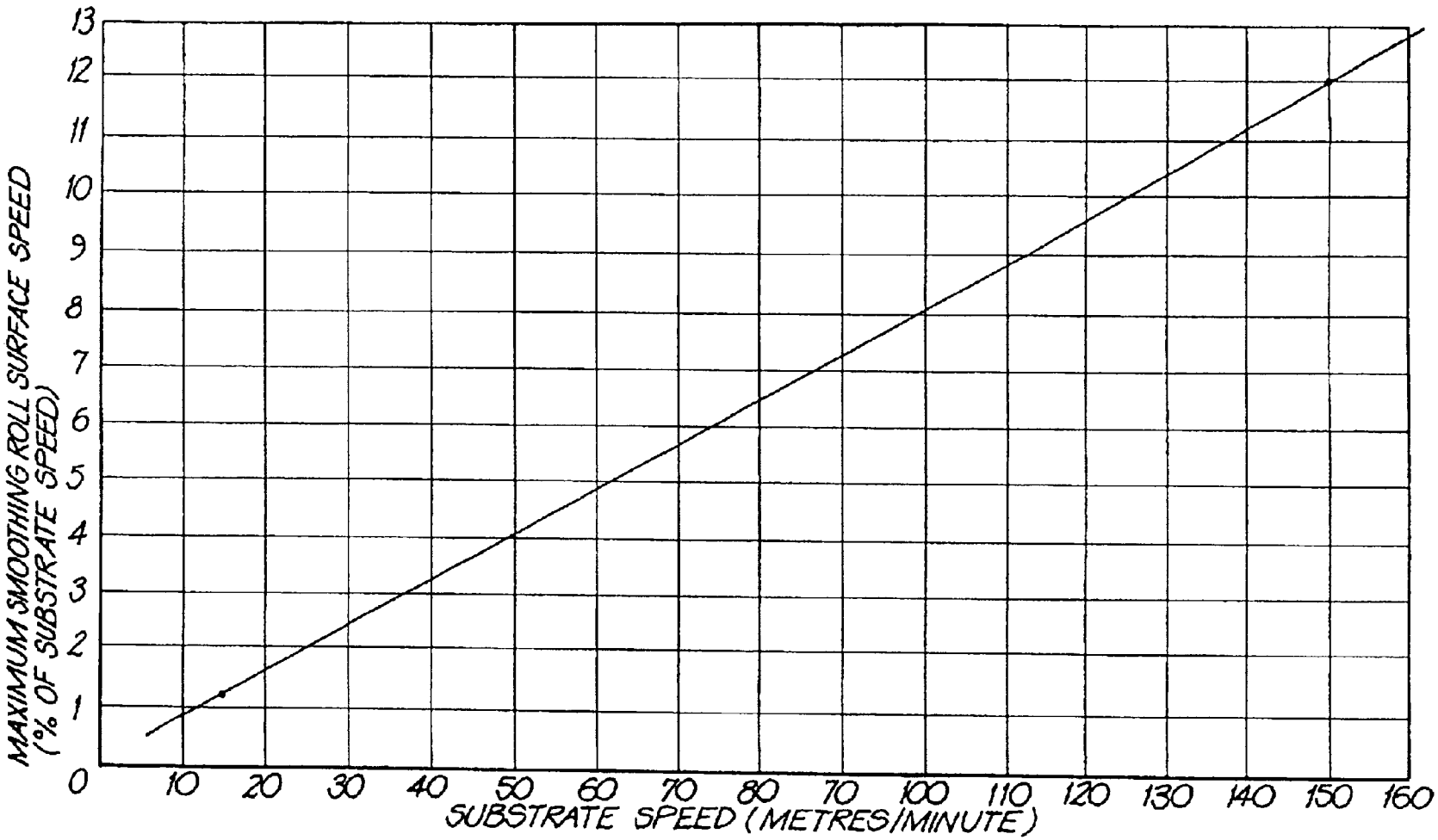
FIG. 3 is a graph representing the relationship between substrate speed and the maximum surface speed of the smoothing roll over a range of substrate speeds including the exemplary substrate speed values referred to in the definition of the method of the invention.

Basically, one may say that a speed relationship meeting the requirements of the invention is satisfied for any point below the graph line of FIG. 3. Having said that, it should be pointed out that zero speed is not preferred for reasons relating to commercial practicality. Occasionally a large adventitious particle may be present in the paint composition. If the smoothing roll is stationary, such a particle may not pass through the nip for a lengthy period causing a corresponding flaw in a long length of finished product. Also rotation, including very slow rotation, spreads the wear of the smoothing roll over its entire surface, leading to a longer operational life than would be the case with a stationary roll. Therefore preferred embodiments of the invention utilise roll surface speeds of the order of from 0.025 to 0.2 meters per minute.

It is known in the circumstances of the illustrated apparatus that the slower the smoothing roll surface speed is relative to the substrate surface speed then the thinner is the film carried from the nip on the smoothing roll. In preferred embodiments the speed differential between the two moving surfaces is such that the film 8 may have an average thickness of 1 micrometer or less. Paint films of that thickness are difficult to discern with the naked eye.

Applicant does not assert (hat the following hypothesis is correct, nevertheless it is suggested that the film 8 is so thin that it constitutes a boundary layer that moves through the nip at substantially the constant speed of the smoothing roll surface. Furthermore the layer 7 of paint composition on the strip is carried away from the nip at the relatively high speed of the strip. Thus it is suggested that the bulk of the paint composition travels through the nip at or very near the speed of the strip. It follows that a very high shear strain is produced in a very thin layer of the composition identified by the broken line shown within the reserve quantity 6. It is hypothesised that the very small amount of composition in that thin layer of high shear strain coupled with the smoothness of the surface of the film defining one side of it (due to its thinness and the smoothness of the roll surface) produces a corresponding smoothness in the surface of the composition stream (appearing as paint coat 7) departing from the nip. Be that as it may, the results of experimental tests leading to the present invention show conclusively that a superior smoothness is exhibited by the finished paint coat on the substrate by methods within the stipulated parameters of the invention, by comparison with similar methods of the prior art not complying with those parameters.

In support of that statement, the results of a number of such tests are listed in Table 1 below. The data, operational conditions and results recorded in Table 1 do not necessarily represent optimum production parameters that would be used commercially. Rather, the examples of Table 1 were designed to illustrate the scope and range of the parameters identified in the invention. Furthermore, production line availability meant that the number of examples at high strip speed was limited.

Table 1 also includes examples that fall within the present invention, being Sample Nos 2, 3, 4, 9, 12, 13, 15, 18, 19, 21, 23, 24 and 26. As can be seen, each of these examples produces a coating having a visually assessed smoothness of good or better. The remaining Sample Nos. which do not fall within the scope of the present invention, have a visually assessed smoothness of poor or very poor.

TABLE 1

| Sample No | Smoothing Roll Ra | Smoothing Roll Speed mpm | Smoothing Roll Speed-% of Strip Speed | Strip Speed mpm | Substrate Ctg Thcknss μm | Coating Smoothness Vis Rating |
|---|---|---|---|---|---|---|
| 1 | 1.42 | 0.23 | 1.5% | 15 | 20 | 5 |
| 2 | 1.40 | 0.17 | 1.1% | 15 | 19 | 3 |
| 3 | 1.27 | 0.17 | 1.2% | 15 | 19 | 3 |
| 4 | 0.71 | 0.15 | 1.0% | 15 | 19 | 2 |
| 5 | 1.76 | 0.85 | 2.8% | 30 | 18 | 5 |
| 6 | 1.76 | 0.66 | 2.2% | 30 | 19 | 4 |
| 7 | 1.62 | 0.67 | 2.2% | 30 | 19 | 4 |
| 8 | 1.33 | 0.87 | 2.9% | 30 | 18 | 5 |
| 9 | 0.72 | 0.68 | 2.3% | 30 | 19 | 3 |
| 10 | 1.78 | 1.23 | 3.1% | 40 | 18 | 4 |
| 11 | 1.35 | 1.55 | 3.9% | 40 | 18 | 5 |
| 12 | 1.28 | 1.24 | 3.1% | 40 | 19 | 3 |
| 13 | 0.77 | 0.75 | 1.9% | 40 | 23 | 2 |
| 14 | 0.62 | 1.63 | 4.1% | 40 | 18 | 4 |
| 15 | 0.61 | 0.19 | 0.5% | 40 | 19 | 1 |
| 16 | 1.70 | 0.94 | 1.9% | 50 | 19 | 4 |
| 17 | 1.37 | 2.48 | 4.9% | 50 | 19 | 5 |
| 18 | 1.29 | 0.94 | 1.9% | 50 | 20 | 3 |
| 19 | 0.78 | 0.94 | 1.9% | 50 | 22 | 2 |
| 20 | 0.75 | 2.52 | 5.0% | 50 | 18 | 4 |
| 21 | 0.65 | 1.88 | 3.8% | 50 | 20 | 3 |
| 22 | 1.80 | 8.74 | 8.7% | 100 | 20 | 4 |
| 23 | 1.19 | 5.10 | 5.1% | 100 | 20 | 3 |
| 24 | 0.78 | 2.05 | 2.1% | 100 | 21 | 1 |
| 25 | 0.60 | 14.79 | 12.3% | 120 | 21 | 4 |
| 26 | 0.58 | 2.40 | 1.6% | 150 | 28 | 1 |

| Visual Rating | | No ribbing visible at cms |
|---|---|---|
| 1 | Excellent | 20 |
| 2 | Very good | 30 |
| 3 | Good | 50 |
| 4 | Poor | 80 |
| 5 | Very poor | 100 |

Samples rated 4 or 5 have smoothing roll Ra or speed parameters outside claim scope.

FIG. 2 illustrates apparatus for effecting the method of the invention wherein the substrate surface on which the paint coat is formed is the surface of a rubber coated transfer roll 9 whereby the coat is transferred to a moving strip 4 on which it is caused or allowed to set to constitute the finished painted product. The remaining components in FIG. 2 bear reference numerals corresponding to those on corresponding components of the FIG. 1 embodiment and are not further described herein. It is mentioned however that the smoothing roll 3 of this embodiment may be a steel roll or a very hard rubber surfaced roll.

What is claimed is:

1. A method of providing a smooth paint coat of an organic polymeric paint composition on a surface of a moving substrate, comprising establishing a quantity of the paint composition, in a high solids form at a temperature such that it is spreadable, in a nip defined by the substrate surface and a smoothing roll to enable paint from the established quantity to pass through the nip as a paint layer on the substrate surface, wherein the smoothing roll has a surface roughness coefficient ($R_a$) of no more than 1.5, and wherein the maximum surface speed of the smoothing roll expressed as a percentage of the substrate speed bears a linear relationship to the substrate speed, such that the surface speed of the smoothing roll is no more than 1.2 percent of the substrate speed at an exemplary low substrate speed of 15 meters per minute and no more than 12 percent of the substrate speed at an exemplary substrate speed of 150 meters per minute.

2. A method according to claim 1 wherein the direction of movement of the surface of the smoothing roll at the nip is the same as that of the surface of the substrate.

3. A method according to claim 1 wherein the surface speed of the smoothing roll is zero.

4. A method according to claim 1 wherein the surface roughness coefficient ($R_a$) of the smoothing roll is no more than 0.8.

5. A method according to claim 1 wherein the step of establishing said quantity of paint composition in the nip is effected by depositing paint composition on the substrate at a position upstream of the nip between it and the smoothing roll at a deposition rate substantially equal to and not less than the rate at which paint composition is carried from the nip by the substrate.

6. A method according to claim 1 wherein the step of establishing said quantity of paint composition in the nip is effected by depositing paint composition on the smoothing roll at a position upstream of the nip between it and the substrate at a deposition rate substantially equal to and not less than the rate at which paint composition is carried from the nip by the substrate.

7. A method according to claim 1 wherein the step of establishing said quantity of paint in the nip is effected by depositing paint composition directly in the nip or directly into a pool of paint composition established in the nip.

8. A method according to claim 1 wherein the speed differential between the substrate and the surface speed of the smoothing roll is selected to ensure that paint composition carried by the smoothing roll from the nip constitutes a film on the smoothing roll having an average thickness of no more than 1 micrometer.

9. A method according to claim 1 wherein the substrate surface is that of a strip to be painted.

10. A method according to claim 1 wherein the substrate surface is that of a transfer roll, and which includes the further step of transferring the paint coat carried from the nip by the transfer roll to the surface of a strip to be painted.

11. A method according to claim 10 wherein the transfer roll is a rubber surfaced roll.

12. A method according to claim 1 wherein the temperature of the paint composition in the nip falls within the range of from 20° C. to 200° C.

* * * * *

UNITED STATES PATENT AND TRADEMARK OFFICE

CERTIFICATE OF CORRECTION

PATENT NO. : 6,759,092 B2
DATED : July 6, 2004
INVENTOR(S) : Udo Wolfgang Buecher It is certified that error appears in the above-identified patent and that said Letters Patent is hereby corrected as shown below:

Title page,
Item [57], ABSTRACT,
Line 5, please delete "hip" and replace with -- nip --

Signed and Sealed this

Seventeenth Day of May, 2005

JON W. DUDAS
*Director of the United States Patent and Trademark Office*